US006979167B2

(12) United States Patent
Geraghty

(10) Patent No.: US 6,979,167 B2
(45) Date of Patent: Dec. 27, 2005

(54) EXCAVATOR COUPLER ASSEMBLY

(75) Inventor: William F. Geraghty, Cumberland, MD (US)

(73) Assignee: Rockland, Inc., Bedford, PA (US)

( * ) Notice: Subject to any disclaimer, the term of this patent is extended or adjusted under 35 U.S.C. 154(b) by 150 days.

(21) Appl. No.: 10/270,679

(22) Filed: Oct. 16, 2002

(65) Prior Publication Data

US 2004/0076504 A1 Apr. 22, 2004

(51) Int. Cl.[7] ..... E02F 3/36

(52) U.S. Cl. ..... 414/723; 37/468; 403/321; 172/272; 172/273; 172/274; 172/275

(58) Field of Search ..... 414/723; 37/468; 403/321; 172/272, 273, 274, 275

(56) References Cited

U.S. PATENT DOCUMENTS 5,382,110 A * 1/1995 Perotto et al. ..... 403/322.3
5,494,396 A * 2/1996 Geier et al. ..... 414/723
5,951,192 A * 9/1999 Collins ..... 403/150
6,058,633 A * 5/2000 Barden ..... 37/468
6,438,875 B1 * 8/2002 Kimble et al. ..... 37/468
6,481,124 B1 * 11/2002 Miller et al. ..... 37/468

* cited by examiner

*Primary Examiner*—Eileen D. Lillis
*Assistant Examiner*—Michael Lowe
(74) *Attorney, Agent, or Firm*—Stevens, Davis, Miller & Mosher, LLP

(57) ABSTRACT

An assembly for detachably connecting an implement having a pair of mounting pins to a machine provided with a dipper stick having a pair of side walls and a mounting pin and a pair of tilt links each having a mounting pin, generally consisting of a first component including a first pair of elongated members each mountable on a side wall of the dipper stick and having an opening for receiving therethrough an end portion of the mounting pin of the dipper stick, means for detachably securing a portion thereof to the dipper stick, means for detachably securing one of the mounting pins of the implement thereto, and means interconnecting such elongated members; and a second component including a second pair of elongated members, each mountable on a side of one of the tilt links, and having an opening for receiving therethrough an end portion of the mounting pin of such one tilt link, means for detachably securing a portion thereof to such one tilt link, means for detachably securing the other of the mounting pins of the implement thereto and means interconnecting the second pair of elongated members together.

13 Claims, 2 Drawing Sheets

EXCAVATOR COUPLER ASSEMBLY

This invention relates to a coupling assembly and more particularly to an assembly mountable on the dipper stick of an excavating machine for detachably coupling an implement to such dipper stick.

BACKGROUND OF THE INVENTION

Conventional excavating machines typically include a main frame or platform which may be trained about a vertical axis, a boom mounted on such a frame for pivotal movement about a horizontal axis, a hydraulic cylinder assembly interconnecting the frame and the boom for pivoting the boom, a dipper stick pivotally connected to the free end of the boom for pivotal movement about a horizontal axis and a hydraulic cylinder assembly operatively interconnecting the boom and dipper stick for pivoting the dipper stick. The free end of the dipper stick is provided with a connecting pin for pivotally connecting an implement such as an excavating bucket thereon. Such implement normally is pivoted about the axis of its pivotal connection with the dipper stick by means of an assembly including a pair of support, links pivotally connected to the dipper stick at a short distance of the connecting pin for the implement, a hydraulic cylinder assembly operatively interconnected between the dipper stick and a connecting pin pivotally connected to the free ends of the support links and a pair of tilt links pivotally connected at one set of ends thereof to the connecting pin provided at the free ends of the support links and pivotally connected at the other ends thereof to the implement.

Often, machines of the type described are provided with a dedicated implement such as an excavating bucket. Many of such machines, however, may be provided with coupler assemblies mountable on the dipper stick and tilt links which are adapted to detachably connect various types of implements to the dipper stick of the machine. Such coupler assemblies may be large and bulky adding additional mass to the front end of the machine which is undesirable in that it not only diminishes the payload of the machine but requires more energy to operate. Accordingly, it is the principal object of the present invention to provide an improved coupler assembly mountable on the dipper stick of the type of machine described for detachably coupling a variety of implements having pairs of parallel, spaced mounting pins, which is simple in design, comparatively lightweight, easy to mount on the dipper stick of the machine and simple to use in attaching and detaching an implement to and from the dipper stick.

BRIEF DESCRIPTION OF THE INVENTION

The present invention provides an assembly for detachably connecting an implement having a pair of mounting pins to the dipper stick of a machine, having a pair of side walls and a mounting pin on the free end thereof and a pair of tilt links each having a mounting pin, generally including a first component having a first pair of elongated plate members, each mountable on a side of the dipper stick and having an opening for receiving the mounting pin of the dipper stick therethrough, means for detachably securing a portion thereof to the dipper stick and means for detachably securing one of the mounting pins of the implement thereto and means interconnecting such first pair of plate members; and a second component having a second pair of elongated plate members, each mountable on a side of one of the tilt links, an opening for receiving the mounting pin of the tilt link therethrough, means for detachably securing a portion thereof to such tilt link and means for detachably securing the other of the mounting pins of the implement, and means interconnecting the pair of plate members thereof together.

DETAILED DESCRIPTION OF THE PREFERRED EMBODIMENT OF THE INVENTION

Figure 3:
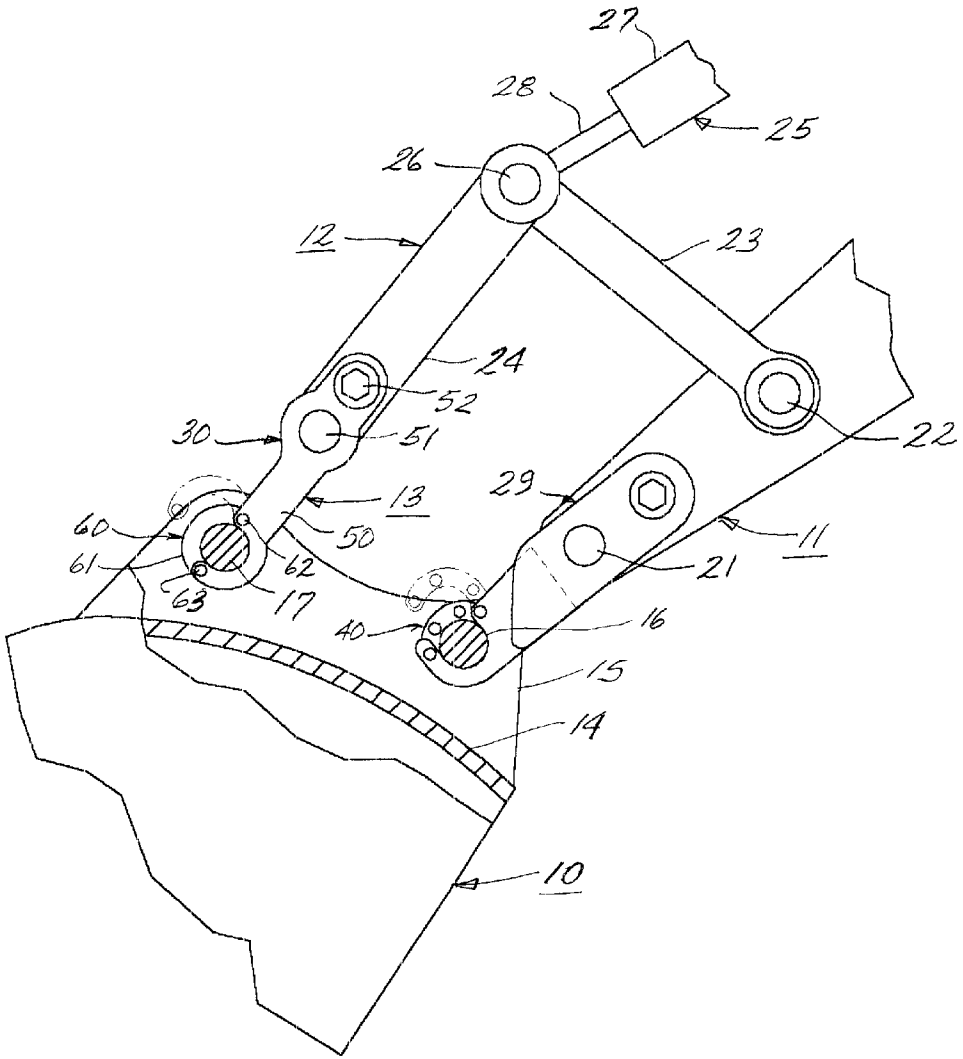
FIG. 3 is a side elevational view of the dipper stick of a machine as described, having a coupler assembly mounted thereon embodying the present invention, illustrating an implement detachably connected to such dipper stick by means of such coupler assembly and having portions thereof broken away.

Referring to FIG. 3 of the drawings, there is illustrated an implement 10, a dipper stick 11 of a machine of the type described, a tilt assembly 12 mounted on the dipper stick and an assembly 13 for detachably coupling implement 10 to the dipper stick and tilt assembly. The implement shown consists of a conventional excavator bucket having a rear wall 14 provided with a pair of longitudinally disposed, transversely spaced mounting brackets 15, 15. Supported on the mounting brackets is a pair of spaced, transversely disposed mounting pins 16 and 17.

Figure 1:
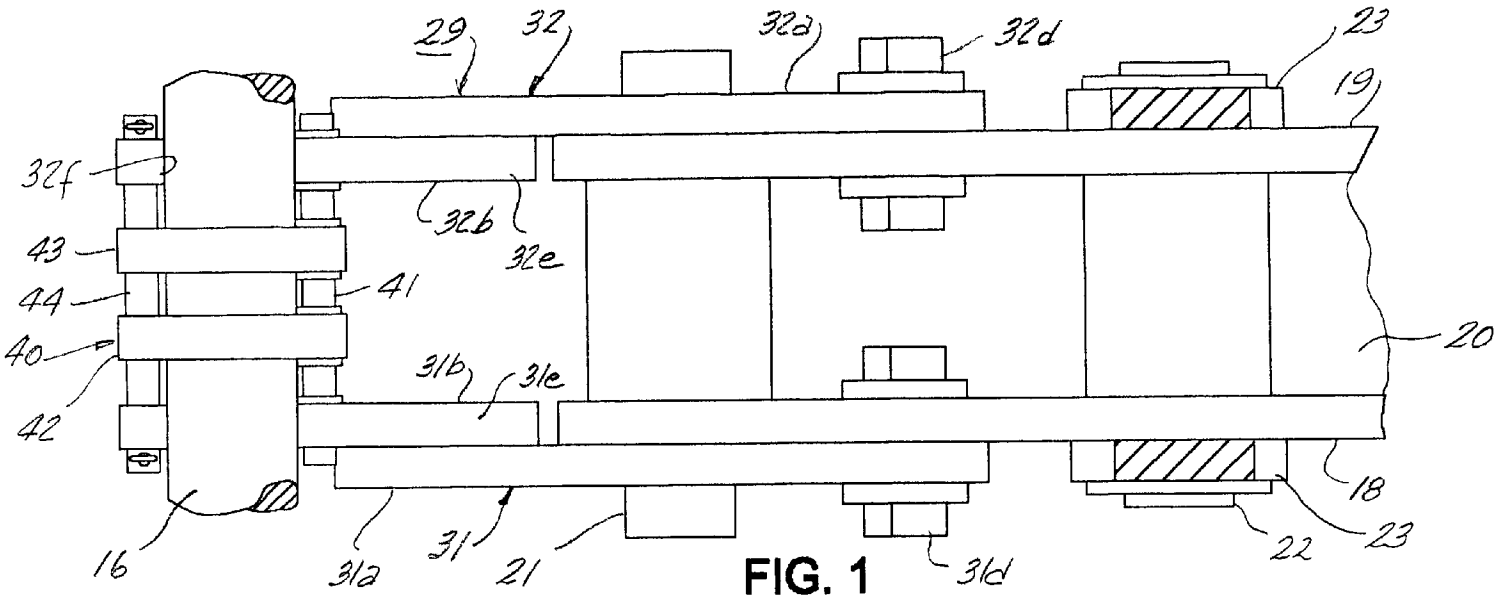
FIG. 1 is a top plan view of the free end a dipper stick having mounted thereon a coupler assembly embodying the present invention, shown coupling an implement to the dipper stick, having the upper wall member of the dipper stick removed to disclose the interior of the dipper stick and having portions thereof broken away.
Figure 2:
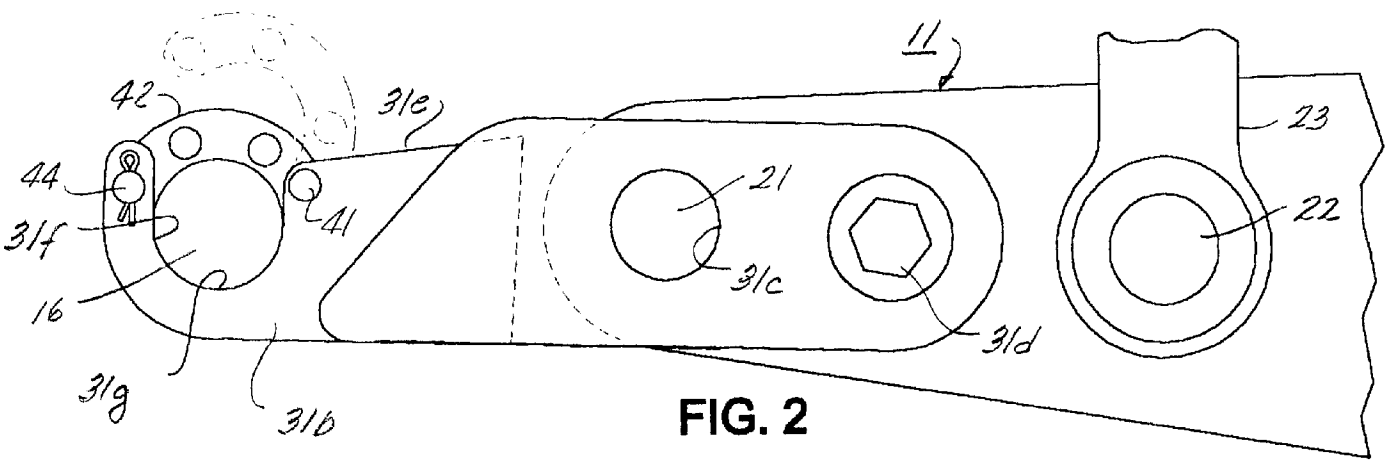
FIG. 2 is a side elevational view of the dipper stick and coupling assembly shown in FIG. 1, illustrating a latch element in a closed position in solid lines and in an open position in phantom lines.

As best seen in FIGS. 1 and 2, dipper stick 11 includes a pair of parallel side walls 18 and 19, an interconnecting bottom wall 20 and a top wall (not shown), removed to disclose the interior of the free end of the dipper stick. Disposed transversely, adjacent the free end of the dipper stick is a conventional connecting pin 21. Spaced from connecting pin 21 is a second connecting pin 22.

Tilt assembly 12 consists of a pair of parallel, transversely spaced support links 23, 23, a pair of parallel, transversely spaced tilt links 24, 24 and a hydraulic cylinder assembly 25. One set of ends of support links 23, 23 is pivotally connected to the outer ends of connecting pin 22, and the other sets of ends thereof is pivotally connected to a connecting pin 26. Tilt links 24, 24 are pivotally connected at one set of ends thereof to connecting pin 26. Cylinder assembly 25 includes a cylinder member 27 pivotally connected at the base end thereof to a bracket mounted on the upper side of the dipper stick, and a rod member 28 pivotally connected at the free end thereof to connecting pin 26.

Coupler assembly 13 includes a first component 29 mounted on the end of the dipper stick and detachably connectable to mounting pin 16 of the implement, and a second component 30 mounted on the free ends of tilt links 24, 24 and detachably connectable to mounting pin 17 of the implement. As best shown in FIGS. 1 and 2, coupler component 29 essentially straddles the free end of the dipper stick and includes a pair of members 31 and 32. Member 31 consists of a plate portion 31*a* mounted on side wall 18 of the dipper stick and projecting forwardly thereof, and a plate portion 31*b* rigidly secured to the projecting segment of plate portion 31*a* and aligned longitudinally with dipper side wall 18. Member 31 is supported on side wall 18 of the dipper stick by means of an opening 31*c* allowing such member to be mounted on the laterally projecting portion of connecting pin 21, and a bolt 31*d* extending through registerable openings in the rear end of plate portion 31*a* and side wall 18, and provided with a fastening nut. The upper end 31*e* of plate portion 31*b* is provided with a recess 31*f* adjacent a forward end thereof, having an arcuate bottom wall 31*g*. Plate member 32 is similar to plate member 31 and includes a plate portion 32*a* and plate portion 32*b*. Plate portion 32*a* also is provided with an opening comparable to opening 31*c* for mounting plate portion 32*a* on the laterally projecting end of connecting pin 21 and a bolt 32*d* which extends through registerable openings in plate portion 32*a* and end wall 19 of the dipper stick which is provided with a fastening nut to firmly secure plate member 32 to side wall 19 of the dipper stick. Plate portion 32*b* similarly is disposed in longitudinal alignment with side wall 19 of the dipper stick. The upper edge 32*e* thereof is provided with a recess 32*f* disposed in transverse alignment with recess 31*f* and provided with an arcuate bottom surface comparable to surface 31*g*.

Coupler member 29 is adapted to be detachably secured to mounting pin 16 by means of a latch assembly 40. Such assembly includes a support pin 41, a pair of latch elements 42 and 43 and a locking pin 44. Support pin 41 is permanently mounted in a pair of transversely aligned openings in plate portions 31*b* and 32*b* adjacent the upper ends thereof, and latch elements 42 and 43 are pivotally connected at the rear ends thereof to support pin 41. Each of latch elements 42 and 43 has an arcuate configuration providing an arcuate inner surface and an opening in the free end thereof adapted to register with transversely aligned openings in the ends of plate portions 31*b* and 32*b* when such elements are in closed positions with the inner, arcuate surfaces thereof resting on a connecting pin 16 received within recesses 31*f* and 32*f*, as shown in the drawings, to receive locking pin 44 therethrough. Latch elements 42 and 43 are displaceable between open positions as illustrated in phantom lines in FIGS. 2 and 3 for receiving mounting pin 16 of an implement in recesses 31*f* and 32*f*, and a closed position as shown in solid lines. When in the closed positions, the latch elements may be secured therein by locking pin 44. Such locking pin may be prevented from being removed from the locking position by means of a pair of cotter pins or other suitable devices.

Coupler component 30 is similar in construction and function to coupler component 29. It includes a pair of plate members 50, 50 comparable to plate members 31 and 32, connectable to tilt links 24, 24 in a manner comparable to the connection of plate members 31 and 32 to the side walls of dipper 11 and detachably connectable to mounting pin 17 of implement 10 in the same manner as plate members 31 and 32. As best seen in FIG. 3, the plate member 50 shown is connected to tilt link 24 shown by means of an opening receiving the laterally projecting end of a connecting pin 51 therethrough and a bolt 50 permanently securing the plate member to the tilt link. Coupler component 13 further is provided with a latch assembly 60 comparable to latch assembly 40. It includes a pair of latch elements 61, 61 pivotally mounted on a connecting pin 62 provided in tilt links 50, 50 and a lock pin 63 received in registerable openings in plate members 50, 50 and the latch elements when such latch elements are in the closed position engaging mounting pin 17 as shown in FIG. 3.

Coupler assembly 13 may be mounted on dipper stick 11 and tilt assembly 12 by first mounting coupler component 29 on the end of dipper stick 12 and then mounting coupler component 30 on the ends of tilt links 24, 24. In mounting coupler component 29 on the dipper stick, plate members 31 and 32 are first mounted on connecting pin 21 against the side wall of the dipper and such members are secured to the dipper stick by bolts 31*d* and 32*d*. Once such members have been secured to the outer sides of the dipper stick, they may be interconnected by means of connecting pin 41. Coupler component 30 is then mounted on tilt links 24, 24 by mounting each of plate members 50 on a tilt link in a manner similar to the mounting of plate members 31 and 32 and interconnecting such plate members by means connecting pin 61.

If implement 10 in the position as shown in FIG. 3, usually resting on the ground, such implement may be detachably connected to dipper stick 11 and tilt assembly 12 by first maneuvering the dipper stick and coupler component 29 with the latch elements thereof in the open position so that pin 16 of the implement is received within aligned openings 31*f* and 32*f* of plate members 31 and 32. The latch elements may then be pivoted to confine the connecting pin of the implement in such recesses. Locking pin 44 may then be inserted to lock the latch elements in the closed position. Tilt assembly 12 and possibly the dipper stick then may be operated to maneuver coupler component 13 to receive mounting pin 17 within the recesses provided in plate members 50, 50. Once such pin has been received therein, the latch elements of such component may be moved to the lock positions, as shown in FIG. 3, and locked therein by means of locking pin 62 to pivotally connect the implement to the tilt assembly. The dipper stick and tilt assembly may then be operated in the conventional manner to manipulate the implement to perform various functions such as excavating and the like.

Each of the coupler components is formed simply of a pair of plate members having openings for receiving the end portions of the connecting pins of the dipper stick and tilt links, a set of bolts for firmly securing the inner ends of such members to the dipper stick or the tilt links, means disposed at the outer ends thereof for detachably connecting a mounting link of implement thereto and means interconnecting the plate members. Such components may be readily formed from plate steel and are comparatively lightweight which provides a minimal addition of front end load to the machine. The simplicity of the design of the coupler assembly not only facilitates its manufacture, assembly and use but further provides a lightweight assembly which does not materially diminish the payload of the machine.

From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

I claim:

1. An assembly for detachably connecting an implement having a pair of mounting pins to a machine provided with a dipper stick having a pair of side walls and a mounting pin therein and a pair of tilt links each having a mounting pin therein, comprising:

a first component including a first pair of elongated members, each mountable on a side wall of said dipper stick and having an opening for receiving therethrough an end portion of said mounting pin of said dipper stick, means for detachably securing a portion thereof to said dipper stick and means for detachably securing one of said mounting pins of said implement thereto, and means interconnecting said first pair of elongated members; and a second component, separate from said first component, including a second pair of elongated members, each mountable on a side of one of said tilt links, an opening for receiving therethrough an end portion of said mounting pin of said one tilt link, means for detachably securing a portion thereof to said one tilt link, means for detachably securing the other of said mounting pins of said implement thereto, and means interconnecting said second pair of elongated members together.

2. An assembly according to claim 1 wherein said means for detachably securing each of said elongated members of said first component to said dipper stick comprises a bolt threaded into a threaded opening in an adjacent side wall of said dipper stick.

3. An assembly according to claim 1 wherein said means for detachably securing each of said elongated members of said second component to one of said tilt links comprises a bolt threaded into a threaded opening in an adjacent side wall of said one tilt link.

4. An assembly according to claim 1 wherein said means for detachably connecting said one mounting pin of said implement to said elongated member of said first component, includes a recess for receiving said one mounting pin therein and a latch for retaining said one mounting in said recess.

5. An assembly according to claim 4 wherein said latch is pivotally connected to said elongated member and angularly displaceable between an open position allowing said one mounting pin of said implement to be received in said recess and a closed position across said recess to retain said one mounting pin of said implement in said recess, and is provided with an opening registerable with an opening in said one elongated member when said latch is in said closed position, and including a pin insertable in said openings in said latch and said one elongated member when said openings are registered, for locking said latch in said closed position.

6. An assembly according to claim 4 wherein said recesses of said elongated members of said first component are transversely aligned.

7. An assembly according to claim 4 wherein said recess includes an arcuate bottom wall.

8. An assembly according to claim 7 wherein said latch is arcuate.

9. An assembly according to claim 1 wherein said means for detachably connecting one of said mounting pins of said implement to said elongated member of said second component, includes a recess for receiving said one mounting pin of said component therein and a latch for retaining said mounting pin in said recess.

10. An assembly according to claim 9 wherein said latch is pivotally connected to said elongated member and angularly displaceable between an open position allowing said one mounting pin of said implement to be received in said recess and a closed position across said recess to retain said one mounting pin of said implement in said recess, and is provided with an opening registerable with an opening in said one elongated member when said latch is in said closed position, and including a pin insertable in said openings in said latch and said one elongated member when said openings are registered, for locking said latch in said closed position.

11. An assembly according to claim 10 wherein said recesses of said elongated members of said second component are transversely aligned.

12. An assembly according to claim 9 wherein said recess is provided with an arcuate bottom wall.

13. An assembly according to claim 12 wherein said latch is arcuate.

* * * * *